US009981195B2

(12) United States Patent
Yarro

(10) Patent No.: US 9,981,195 B2
(45) Date of Patent: May 29, 2018

(54) THREE DIMENSIONAL ILLUMINATION TOY

(71) Applicant: Tanner James Yarro, Provo, UT (US)

(72) Inventor: Tanner James Yarro, Provo, UT (US)

(73) Assignee: Proto.Toys, Inc., Springville, UT (US)

( * ) Notice: Subject to any disclaimer, the term of this patent is extended or adjusted under 35 U.S.C. 154(b) by 0 days. days.

(21) Appl. No.: 15/213,098

(22) Filed: Jul. 18, 2016

(65) Prior Publication Data

US 2018/0015378 A1 Jan. 18, 2018

(51) Int. Cl.

| | |
|---|---|
| ***A63H 3/00*** | (2006.01) |
| ***A63H 33/22*** | (2006.01) |
| ***A63H 33/26*** | (2006.01) |
| ***F21V 23/02*** | (2006.01) |
| ***F21V 23/06*** | (2006.01) |
| *F21Y 115/10* | (2016.01) |

(52) U.S. Cl.

CPC ..... *A63H 3/006* (2013.01); *A63H 33/22* (2013.01); *A63H 33/26* (2013.01); *F21V 23/02* (2013.01); *F21V 23/06* (2013.01); *F21Y 2115/10* (2016.08)

(58) Field of Classification Search

CPC ..... A63H 3/006; A63H 3/28; A63H 33/22; A63H 33/26

USPC ..... 446/91, 219, 369, 485

See application file for complete search history.

(56) References Cited

U.S. PATENT DOCUMENTS 2,575,269 A * 11/1951 Hall ..... A63F 3/00075 116/222
3,530,615 A * 9/1970 Meyer ..... A63F 9/06 40/437
3,634,678 A * 1/1972 Glass ..... A41G 1/005 362/122
4,196,539 A * 4/1980 Speers ..... A63F 11/00 40/547
4,891,030 A * 1/1990 Gertzfeld ..... A63F 9/10 446/118
5,324,224 A * 6/1994 Anderson ..... A63H 33/26 362/184
5,391,105 A * 2/1995 Jones ..... A63H 33/22 362/283
5,555,163 A * 9/1996 Pisani ..... G09F 13/28 362/231
5,788,556 A * 8/1998 Morace ..... A63H 33/22 362/551
5,876,262 A * 3/1999 Kelly ..... A63H 33/22 108/23
6,032,393 A * 3/2000 Maxim ..... G09F 9/305 40/547

(Continued)

*Primary Examiner* — Alexander Niconovich
(74) *Attorney, Agent, or Firm* — Durham Jones & Pinegar, P.C., Intellectual Property Law Group

(57) ABSTRACT

Apparatus and method of building a toy or playing a game with a three-dimensional housing or case. The housing may resemble a person or individual or some other three-dimensional design such as a vehicle, plant, animal etc. The housing may include a plurality of holes passing through the housing. The apparatus may include a power supply and a light source within the housing wherein the holes allow the light to pass through the housing. A user may place pegs, which may be colored, within the holes to create a colorful figure that may resemble a predetermined design or a design the user individually creates.

14 Claims, 4 Drawing Sheets

(56) References Cited

U.S. PATENT DOCUMENTS

| | | | | |
|---|---|---|---|---|
| 6,238,261 | B1 * | 5/2001 | Lang | A63H 33/22 434/407 |
| 6,645,038 | B2 * | 11/2003 | Trotto | A63H 33/22 40/547 |
| 6,729,932 | B2 * | 5/2004 | Jarvis | A63H 33/22 362/456 |
| 7,214,118 | B1 * | 5/2007 | Maxim | A63H 33/22 362/249.14 |
| 7,494,243 | B2 * | 2/2009 | Murphy | A61M 21/00 362/231 |
| 7,654,023 | B2 * | 2/2010 | Peters | G09F 9/305 40/547 |
| 9,061,216 | B1 * | 6/2015 | Hooper | A63H 3/006 |
| 9,108,332 | B2 * | 8/2015 | Golden | B26F 1/24 |
| 9,114,326 | B2 * | 8/2015 | Johnson | A63H 3/003 |
| 9,724,615 | B2 * | 8/2017 | Chan | A63H 3/28 |
| 2004/0067713 | A1 * | 4/2004 | Fong | A63H 3/006 446/175 |
| 2013/0040532 | A1 * | 2/2013 | Khubani | A63H 3/006 446/369 |
| 2014/0335757 | A1 * | 11/2014 | Khubani | A63H 3/02 446/219 |

* cited by examiner

THREE DIMENSIONAL ILLUMINATION TOY

TECHNICAL FIELD

This disclosure relates generally to toys and games that illuminate from the interior of the toy and, more specifically, a three dimensional ("3D") illumination system with a light or lighting source on the interior and a 3D design or housing encompassing or surrounding the light source. The designs can take on many 3D forms and may be buildings, persons, animals, plants or any other 3D structure or figure.

RELATED ART

Toys and games that include lights and creating have been around for many years now. Lite Brite® has been making the colored peg backlit two-dimensional peg board since 1967. More recently Hasbro has developed other peg like features that may fit into this two-dimensional peg boards in U.S. Pat. No. 6,238,261. Furthermore a cube like design that allows a user to create two-dimensional displays on 4 or 5 sides of a cube, with the light in the center of the cube, is also available.

Other embodiments of toy illuminating devices are disclosed in the U.S. patents to Speers U.S. Pat. No. 4,196,539, Anderson et al U.S. Pat. No. 5,324,224, Jones U.S. Pat. No. 5,391,105 and Kelley et al U.S. Pat. No. 5,876,262 which, other than the existing LITE BRITE® device.

While these toys, games and devices have been utilized for years, there has never been a device that allows a three-dimensional illumination system that may utilize light emitting pegs placed into the three-dimensional figure to create a display that may resemble a known figure, whether the figure is fictitious or non-fictitious. The three-dimensional device may be any building, person, animal, plant or any other 3D structure or figure.

SUMMARY

This disclosure, in at least on aspect, relates to the use of a game or toy that utilizes a light source with a cage, case or housing around the light source that allows light to escape from the housing. More generally the housing may include numerous openings or holes that allow light to pass through the housing. A user may place pegs of different sizes, shapes and colors within the openings to create a desired design.

The housing may be a three-dimensional ("3D") image that may resemble any number of characters, animals, plants, buildings or the like. The housing may include a front portion and a back portion that connect together. In between the housing a light source may reside central to the front and back portion and may provide a securing means to hold the front and back portions together. Alternatively you could have a first side portion and a second side portion that connect in a similar manner only side to side, instead of front to back. Also, you may be able to have a top portion and bottom portion that secure to each other in a manner similar to the front and back portions.

The light source may comprise a substantially slim profile and the lights utilized may be incandescent, fluorescent or light emitting diodes (LEDs) or other light emitting sources (hereinafter "lights"). The number and positioning of the lights may be such as to provide substantially the same amount of light emission through each of the openings in the housing. The central portion that maintains the lights may also include a battery pack or other power source that powers the lights within the toy. The toy or game may be powered by batteries or other electronic means such as an outlet for a plug that may be plugged into an outlet into the wall of a home.

There is a plurality of means and methods for securing the housing(s) around a light source and multiple variations of 3D images that could be utilized. Other aspects, as well as features and advantages of various aspects of the disclosed subject matter will become apparent to one of ordinary skill in the art form the ensuing description, the accompanying drawings and the appended claims.

DETAILED DESCRIPTION

Figure 1:
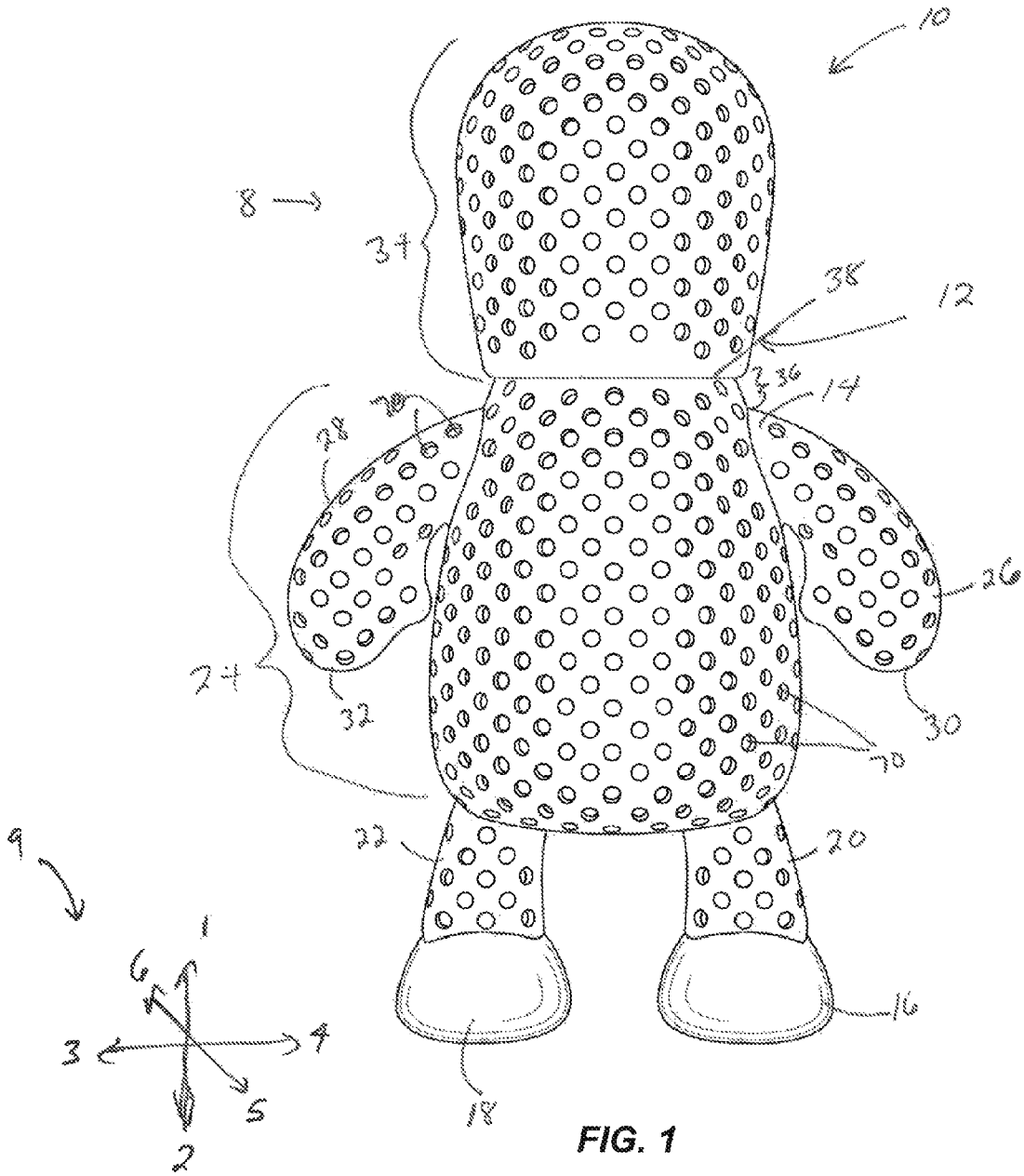
FIG. 1 is front view of a toy or system with a housing member.

The following description sets for the separate embodiments of a toy or system that may allow a user to create or design a three-dimensional (3D) image that will illuminate from the interior. A user may place pegs of different sizes, shapes and designs at least partially within a housing to create a figure which may be a fictitious or non-fictitious character or building or vehicle or animal or plant, etc.

FIGS. 1-4 figures may be oriented according to the reference arrow diagram 9, having a superior direction 1, an inferior direction 2, a right lateral direction 4, a left lateral direction 3, a posterior direction 5, and an anterior direction 6. In this application, "left" and "right" are used with reference to a posterior view. "Medial" refers to a position or orientation toward a sagittal plane (i.e., plane of symmetry that separates left and right sides of the body from each other), and "lateral" refers to a position or orientation relatively further from the sagittal plane.

FIG. 1 illustrates one embodiment of a toy or system 10 in a first configuration 8 with a housing 12 which may comprise the entire outside of the toy 10. The housing 12 may be include multiple parts or pieces that when joined together form the housing 12. A first member 14 may comprise the front of the toy 10 and a second member 15 (See FIG. 2) may comprise the back of the toy 10. The first member 14 may include a first base 16 and a second base 18 that may resemble, in this particular embodiment, feet or stubs that may aid in providing a sturdy base or foundation so the toy 10 may stand effectively. The first and second bases 16, 18 may have a substantially flat inferior surface to provide a flat base for the toy 10 to reside on such as a table or the floor. A first leg 20 and a second leg 22 may extend from the first and second bases 16, 18 respectively in a superior direction from the base.

A body 24 may extend from the first and second legs 20, 22 in a plurality of directions which may include, laterally, posteriorly, anteriorly and superiorly. The body 24 may have a larger circumference and diameter than the first and second legs 20, 22. The body 24 may provide a bridge or connection between the first and second legs 20, 22. The body 24 may be bulbous and/or rounded to give the perception of a torso of a character or individual. A first arm 26 may extend in a right lateral direction 4 and a second arm 28 in a left lateral direction 3, opposite the first lateral direction 4. The first and second arms 26, 28 may extend laterally and may curve to extend inferiorly as well until terminating at a first termination end 30 and a second termination end 32 of the first and second arms 26, 28 respectively. It will be appreciate that the first and second arms 26, 28 may be mirror images of each other or may not be; for example, one arm may extend laterally and superiorly while the other arm may extend laterally and inferiorly. The first and second arms 26, 28 may simply extend laterally to the termination ends 30, 32 as well.

A head 34 may extend from the body 24 in a superior direction from the body 24. The body 24 may taper toward the top portion 36 of the body 24. A neck 38 may comprise the bottom portion of the head 34 with the head 34 tapering at the neck portion 38 (which may be the inferior portion of the head 34) and the neck portion meeting the top portion 36 of the body 24. The head 34 may be bulbous or rounded as it extends from the neck 38 to give the perception of an actual head of a character or individual.

Figure 2:
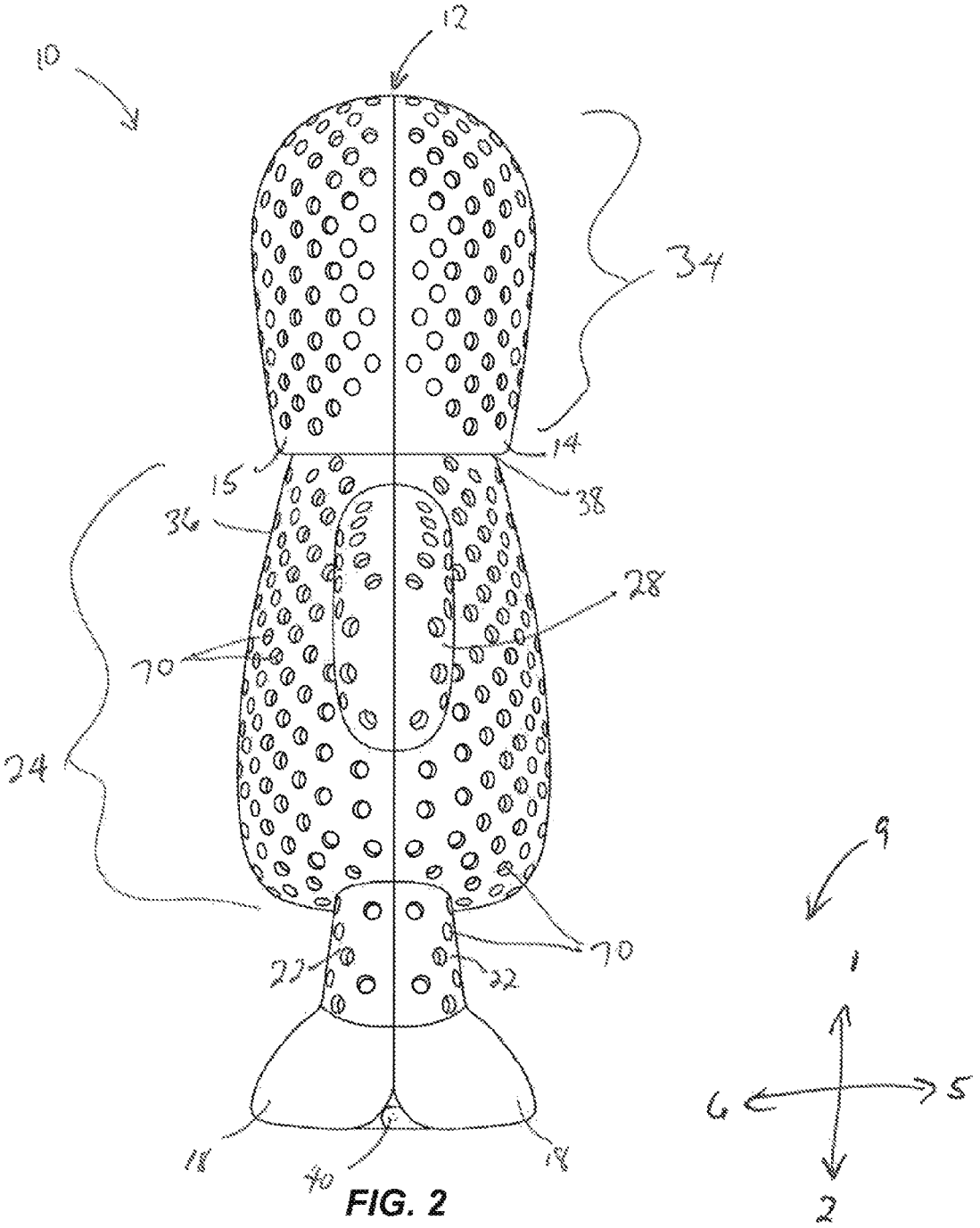
FIG. 2 is side view of the toy or system of FIG. 1 with a front member and a back member.

Referring to FIG. 2, the second member 15 may be substantially similar to the first member 14 so as to create a full 3D character. The first member 14 and second member may engage at the first and second bases 16, 18. The engagement member 40 may be a hinge that allows the first and second members 14, 15 to pivot away from one another along the axis of the hinge 40. The axis of the hinge 40 may extend in a lateral direction. The hinge 40 may be placed at the bottom of the first and second bases 16, 18 or it may be positioned upward on the first and second legs 20, 22 such that the first and second bases 16, 18 may remain stable on the ground or a table that the toy 10 is resting on. The hinge 40 may also be positioned between the first and second legs 20, 22 as the legs engage the body 24.

While the current embodiment may only show a single or double hinge, multiple hinges may be used at multiple locations of the toy 10, for instance at the neck 38, the arms 26, 28, at the top of the legs 20, 22 and/or at the bases 16, 18.

Figure 3:
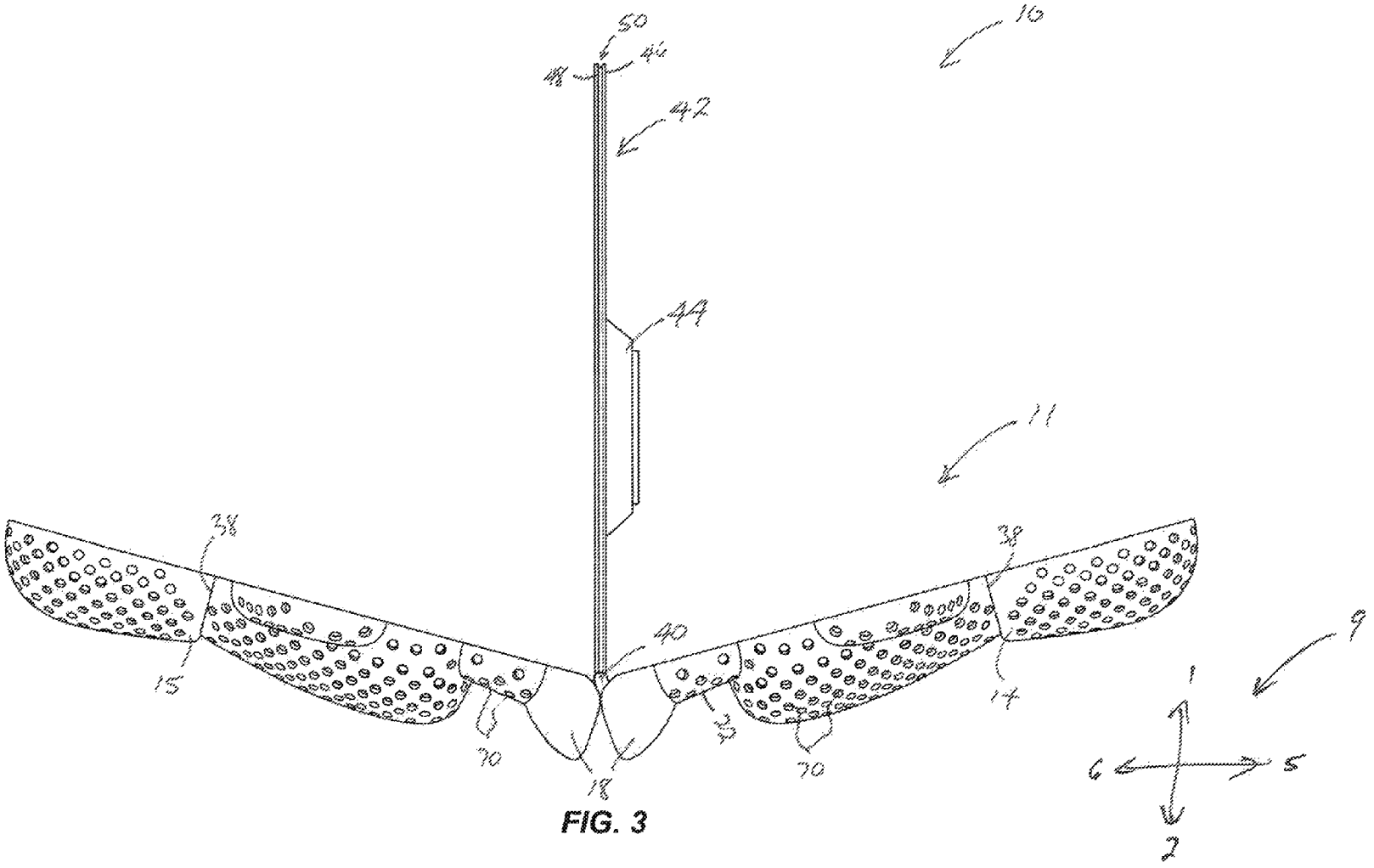
FIG. 3 is a side view of the toy or system of FIG. 1 with the front member and back member opened or separated.

Referring to FIG. 3, the toy 10 is depicted in a second configuration 11 wherein a central member 42 is exposed because the first member 14 and second member 15 are displaced or rotated about the hinge 40. The central member 42, from a lateral view, may be a longitudinally extending, substantially straight design. From a posterior or anterior view the central member may have a profile that matches the first and second members 14, 15.

A battery pack 44 or power supply may be integrated or attached to the central member 42. The battery pack 44 (battery packs may mean alkaline batteries such as AA, 9V, C, D and the like, zinc air battery, mercury, silver oxide or may be lithium-ion batteries, rechargeable batteries or any combination thereof) may extend from the body of the central member 42 and may comprise the necessary electronics to transfer power from the battery pack 44 to the lights. The battery pack 44 may use any battery type and all battery types are contemplated herein. Other power sources may include adaptors that may plug into the toy 10 and then plug into a typical wall outlet.

The central member 42 may include a first ridge 46 and a second ridge 48 with a recess 50 positioned between the first and second ridges 46, 48. The first and second ridges 46, 48 may extend along the perimeter of the central member 42. The first and second ridges 46, 48 may provide a frictional fit with the first member 14 and second member 15. The first and second ridges 46, 48 may require a force to overcome the ridges 46, 48 to engage the first and second members 14, 15 so they form a snap-fit securing the first member 14 to the central member 42 and the second member 15 to the central member 42. It will be appreciated that other engagement features may be utilized and are contemplated such as a press-fit, Velcro®, buttons, snaps, clips, locks, etc.

While FIG. 3 depicts a circumferential recess 50 and first and second ridges 46, 48, it is contemplated that only a portion of the central member 42 may include these features that allow the first and second members 14, 15 to engage the central member 42. For example, only the head portion and arms portions may include the engagement features of the ridges 46, 48 and recess 50. Other engagement features are also contemplated and may be positioned throughout the toy 10 such as pins that may engage receiving apertures (or bosses with apertures) by the pins at least partially entering the apertures and forming a press fit. Another, alternate embodiment may include clips displaced around the outside of the first and second members 14, 15 such that a clip engages a complementary receiving portion wherein the clip and the receiving portions are on opposite members, meaning the first member 14 may comprise a clip and the second member 15 comprise the receiving portion, or vice versa. Alternatively, the clips and receiving portion may alternate between the first and second members 14, 15.

Figure 4:
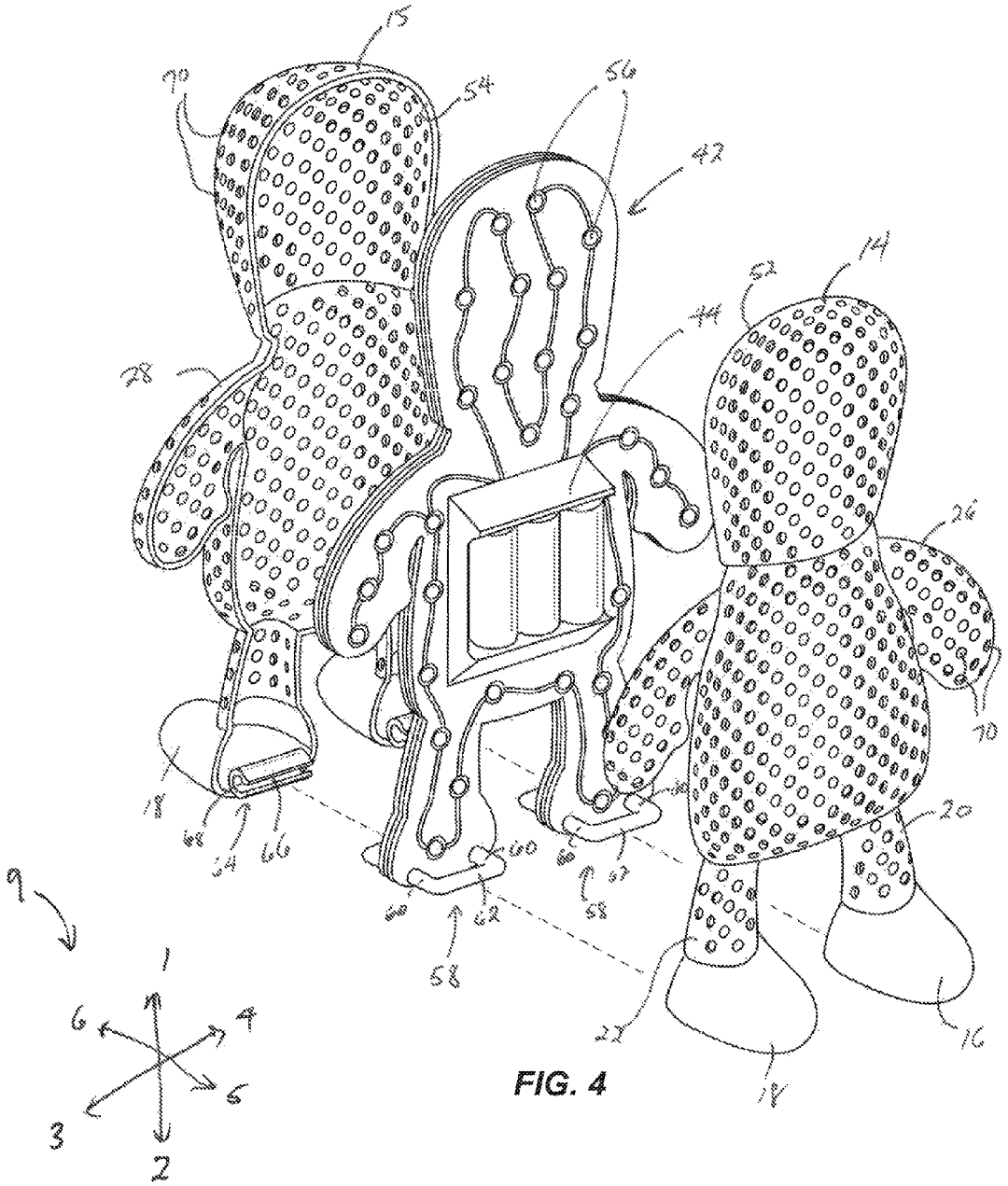
FIG. 4 is an exploded perspective view of the toy or system of FIG. 1 with the front member, back member and central member.

Referring to FIG. 4, the first member 14 may comprise a first lip 52 that runs along the perimeter of the first member 14 on the engagement side of the first member 14. The first lip 52 may engage the first ridge 46 and may require some force for the first lip 52 to overcome the first ridge 46 so that the lip rests within the recess 50 of the central member 42. Likewise, a second lip 54 may run along the perimeter of the second member 15 on the engagement side of the second member 15. The second lip 54 may require some force to overcome the second ridge 48 so that the second lip 54 also rests in the recess 50.

The first member 14 may include a space or void between the outer wall of the first member 14 and the central member. Similarly, the second member 15 may include a space or void between the outer wall of the second member 15 and the central member. The voids may allow for more light to illuminate from within the housing 12. The voids may also be different shapes and depending on the character or figure of the toy 10. The first and second members 14, 15 may also include clips 64, which may be cylindrical clips, with an opening 66 toward one end of the clips 64. The clips may be integral to, or attached to, the bases 16, 18 of the first and second members 14, 15. The openings 66 for the clips extending from the first member 14 may project in an anterior direction 6 and the openings 66 for the clips extending from the second member 15 project in a posterior direction 5. A longitudinal aperture 68 may extend the length of the clips 64.

The central member 42 may include protrusions 58 from the base of the central member 42. Each protrusion 58 may comprise posts 60 extending from the body of the central member 42 wherein the rods 60 may extend perpendicular to the body of the central member and parallel to each other. A rod 62 may extend between the posts 60 connecting the posts 60 via the rod 62 wherein the rod 62 may run parallel to the body of the central member 42. A space may reside between the rod 62, the posts 60 and the central body 42. The openings 66 of the clips 64 may allow for the rod to pressedly engage the clips allowing the rod to reside within the longitudinal aperture 68. With the rod 62 residing within the clips 64 it creates the hinge 40 as previously described herein that allows the first and second members 14, 15 to pivot away from the central member 42. While the clips 64 may snap around the rod 62 it will be appreciated that a number of other hinges may be utilized that are either irreversibly connected or reversibly connected.

The central member 42 may include a plurality of lights 56 positioned throughout the body of the central member 42. The lights 56 may illuminate the toy 10 from within the housing 12. The lights 56 may be connected by a single electrical connection or a plurality of electrical connections that extend from the power source or battery pack 44. The lights may be spaced equidistant from the other lights 56 or may be positioned in a pattern, design or randomly. The pattern or design of the lights 56 may mimic the outline of the character or figure of the toy 10. One or two lights may be used in the concept disclosed herein or multiple lights. The lights 56 may be replaceable in the event one of the lights discontinues working. A switch that effectively "turns on" the toy 10 or switches the lights 56 on, may be positioned anywhere on the toy 10 including on or adjacent to the power source or battery pack 44; however, the switch may also be positioned on the outside of the housing 12 on the base or any other location with an electrical connection from the switch to the power source 44.

Alternatively, the lights 56 may include only a single light in the housing 12 that is positioned within the housing 12 such that it lights up both sides of the first member 14 and second member 15. Another embodiment may include one light extending from the central member 42 into the void of the first member 14 and a second light extending into the void of the second member 15.

Referring to FIGS. 1-4, the toy 10 may include a plurality of apertures 70 that pass through the housing 12. The apertures 70 may be positioned in a pattern and each aperture 70 may be equidistant from the others; however, the positioning of the apertures 70 may be designed depending on the character or figure as well and thus may be positioned closer or in clusters in one embodiment and more spaced apart in other embodiments. The apertures 70 may pass at least partially or entirely through the body of the housing 12 (of the first and second members 14, 15) allowing light to pass through the apertures 70. The apertures 70 may also be the same diameter and may be the same depth. However, alternatively, the depth and diameter of the apertures 70 may change with relation to the position of the aperture 70 on the housing 12.

Pegs may be placed within the apertures 70 to either block light from passing through or the pegs may be colored such that when light passes through the apertures 70 and thus through the pegs the color of the light changes to the color of the peg placed in that aperture 70. The pegs may pressedly fit within the apertures such that the pegs are not easily removed after being positioned within the aperture 70. The pegs may comprise a circumferential ring toward a distal end of the peg that engages a circumferential recess within the aperture 70. Alternatively the circumferential ring may engage the interior facing side of the housing 12 thus preventing easy withdrawal of the peg without a user providing a substantial back-out force opposite the direction of pushing the peg into the aperture 70. The pegs may also include a shoulder toward the proximal end of the peg that may prevent the peg from entering the aperture 70 too deeply providing a "stop" for the peg within the aperture 70.

Alternatively, the pegs may be easily placed and removed from the apertures 70. The pegs may be smaller in diameter than the aperture and thus may be freely positioned or removed from the apertures 70 allowing for easy removal if the toy 10 is tipped or turned or rotated allowing the pegs to easily fall out of the apertures 70.

Multiple pegs may be combined to add a 3D element to the toy 10. For example, a 3D nose feature may be at proximal end and multiple pegs may extend distally from the 3D nose feature wherein each peg of the 3D nose engages a separate aperture 70. The nose feature may be positioned on the head 34 of the toy 10. Other features may include a skirt feature at a proximal end with multiple pegs extending distally that each engage a separate aperture 70. The skirt feature may be positioned on the body 24, or torso portion, of the first and second members 14, 15 creating the appearance of the toy 10 having a skirt on the character. Many other variations of multiple pegs extending from 3D elements are contemplated herein to create characters, buildings, figures, plants, animals and the like. As further contemplated, though, the housing 12 (with the first and second members 14, 15) may include these features by itself thus only requiring pegs to be placed within the apertures to provide the appearance of the desired characters, buildings, figures, plants, animals and the like.

An alternate embodiment contemplated herein also considers the housing member 12 to be a single unitary piece. The light source and power supply may be provided by inserting both the light source and power supply into an opening toward the base of the toy 10 either through the bases 16, 18 or through the inferior portion of the body 24. Alternatively, the power supply may remain outside of the housing 12 and only the light source positioned within the housing. It will be appreciated that an opening may be provided anywhere within the housing to place the light source and that those options described herein are for illustrative purposes only. Similarly when contemplating other three-dimensional designs such as vehicles, plants, animals and the like a one piece, two piece (or even more pieces, if the three-dimensional design would benefit from it and considering multiple hinges, or clips or other engagement features) housing is also considered within the scope of this description as well as the opening for positioning the light source and the power supply.

The pieces and parts of the toy 10 may be made of multiple different materials. The housing may be made of any metal or plastic. The metal or plastic may need to be substantially rigid to hold and maintain the pegs. The central member 42 likewise may be made of a metal or plastic; however, if a metal is utilized and a light source which may produce heat, such as an incandescent bulb than it is preferable that the metal be one that does not transfer heat readily. Similarly with the plastic, the plastic would need to be strong enough to not warp, allow heat transfer or burn if a heated light source is utilized. While any light source is contemplated it is likely that light emitting diodes (LEDs) may be used and thus heat transfer as not much of a concern.

The hinge(s) 40 may be made from a metal source and integrated into the housing 12. However, similar hinges may be made of robust plastics or rubber to allow the same rotation as that of metal hinges.

The dimensions of the toy 10 may vary, such as larger bases 16, 18 or larger circumference legs 20, 22, or arms 26, 28. Additionally, the body 24 may be substantially larger or smaller than what is depicted in the figures. Likewise the head 34 may vary in size as well. In each instance, length, width, diameter may all vary. Furthermore, the overall height, width and diameter may vary as well. For example, the height of the toy 10 may vary from a few centimeters tall to a meter tall. Other measurements may include a height from 4-12 inches a width of 3-8 inches and a depth of 2-5 inches. It is also contemplated that the dimensions of the figure may not be proportionate to that of an actual individual or figure whether fictitious or non-fictitious.

While the present embodiment depicts that of a figure with arms, legs a body and head it is important to note that other three-dimensional objects are contemplated and considered part of this disclosure. For example boats, airplanes, cars, plants, animals and buildings (to name only a few) are all considered herein each with various shapes, sizes, colors and dimensions.

Although the foregoing disclosure provides many specifics, these should not be construed as limiting the scope any of the ensuing claims. Other embodiments may be devised which do not depart from the scopes of the claims. Features from different embodiments may be employed separately or in combination. Accordingly, all additions, deletions and modifications to the disclosed subject matter that fall within the scopes of the claims are to be embraced thereby. The scope of each claim is indicated and limited only by its plain language and the full scope of available legal equivalents to its elements.

What is claimed:

1. A toy comprising:

a rigid housing resembling a person comprising:

a first member and a second member, wherein the first and second members each comprise:

a first base and a second base, a first leg extending from the first base and a second leg extending from the second base;

a body extending from both the first leg and second leg;

a head extending from the body;

a first arm and a second arm extending from the body; and a first engagement member hingedly connecting the first member to the second member, and a plurality of apertures passing through the housing, each aperture configured to receive a peg.

2. The toy of claim 1 comprising: a central member positioned between the first member and second member comprising a second engagement member configured to engage the first member and the second member wherein a first void is positioned between the central member and the first member and a second void is positioned between the central member and the second member.

3. The toy of claim 2, wherein the first engagement member and the second engagement member combine to form a hinge to allow the first member and second member to rotate about the hinge toward or away from one another.

4. The toy of claim 3 comprising: a power supply integral to the central member.

5. The toy of claim 4 comprising: at least one light powered by the power supply.

6. The toy of claim 1, wherein the pegs are colored.

7. The toy of claim 1 further comprising apertures and a power supply and at least one light powered by the power supply, wherein the light passes through the apertures.

8. A system comprising:

a three-dimensional rigid housing substantially shaped like a human figure comprising:

a first base and a second base, a first leg extending from the first base and a second leg extending from the second base;

a body extending from both the first leg and second leg;

a head extending from the body, wherein at least a portion of the head is hingedly connected to the body at a neck;

a first arm and a second arm extending from the body;

a central member within the housing; and a plurality of apertures passing through the housing, each aperture configured to receive a peg.

9. The system of claim 8 further comprising a space between the central member and the housing.

10. The system of claim 9 the central member further comprising a power supply and at least one light wherein the power supply provides power to the at least one light.

11. The system of claim 10 the housing further comprising a plurality of apertures passing through the housing configured to allow light to pass through the apertures.

12. The system of claim 10, wherein the at least one light comprises light emitting diodes.

13. The system of claim 10, wherein the power supply comprises a battery pack.

14. The system of claim 10, wherein the power supply comprises an electrical wire connected to a plug and also connect to the at least one light wherein when the wire is plugged into an electrical socket the at least one light turns on.

* * * * *